US010989457B2

(12) United States Patent
Hosokawa et al.

(10) Patent No.: US 10,989,457 B2
(45) **Date of Patent: *Apr. 27, 2021**

(54) ACCUMULATOR

(71) Applicant: Fujikoki Corporation, Tokyo (JP)

(72) Inventors: Kouji Hosokawa, Tokyo (JP); Takeharu Ozawa, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 134 days.

This patent is subject to a terminal disclaimer.

(21) Appl. No.: 16/334,272

(22) PCT Filed: Sep. 28, 2017

(86) PCT No.: PCT/JP2017/035313

§ 371 (c)(1),
(2) Date: Mar. 18, 2019

(87) PCT Pub. No.: WO2018/079182

PCT Pub. Date: May 3, 2018

(65) Prior Publication Data

US 2019/0226734 A1 Jul. 25, 2019

(30) Foreign Application Priority Data

Oct. 25, 2016 (JP) ..... JP2016-208702
Jan. 11, 2017 (JP) ..... JP2017-002268

(51) Int. Cl.
*F25B 43/00* (2006.01)

(52) U.S. Cl.
CPC ..... *F25B 43/006* (2013.01); *F25B 43/00* (2013.01)

(58) Field of Classification Search
CPC ..... F25B 43/00; F25B 43/043; F25B 39/04; F25B 2400/23; F25B 43/006; F25B 2500/13; F25B 43/04; B60H 1/3229
USPC ..... 62/509, 503
See application file for complete search history.

(56) References Cited

U.S. PATENT DOCUMENTS

| | | | | |
|---|---|---|---|---|
| 3,765,192 A | 10/1973 | Root | | |
| 4,827,725 A * | 5/1989 | Morse | F25B 43/006 | 62/503 |
| 2016/0010906 A1* | 1/2016 | Kaspar | F25B 43/006 | 62/509 |

FOREIGN PATENT DOCUMENTS

| | | | |
|---|---|---|---|
| CN | 103712385 | A | 4/2014 |
| DE | 102007028591 | A1 | 12/2008 |
| EP | 2787306 | A1 | 10/2014 |
| JP | H11-108506 | A | 4/1999 |
| JP | H11-190573 | A | 7/1999 |

(Continued)

OTHER PUBLICATIONS

Supplementary European Search Report for Corresponding European Application No. 17864860.6, dated May 26, 2020, 7 Pages.

(Continued)

*Primary Examiner* — Steve S Tanenbaum
(74) *Attorney, Agent, or Firm* — Lucas & Mercanti, LLP

(57) ABSTRACT

Provided is an accumulator that can effectively suppress impact noise associated with a bumping phenomenon when a compressor is operating, without an increase in the complexity, cost, or size of the accumulator. An inlet port 15 is disposed in the lower portion of a tank 10, and a gas-liquid separation accelerating plate 22 is disposed above inlet port 15 inside the tank 10 so that the gas-liquid separation accelerating plate 22 is opposite the inlet port 15.

13 Claims, 12 Drawing Sheets

(56) References Cited

FOREIGN PATENT DOCUMENTS

| | | | |
|---|---|---|---|
| JP | 2001-248923 | A | 9/2001 |
| JP | 2004-263995 | A | 9/2004 |
| JP | 2006214700 | A | 8/2006 |
| JP | 2014-070869 | A | 4/2014 |
| JP | 2014077606 | A | 5/2014 |
| JP | 2014102058 | A | 6/2014 |
| JP | 2014105907 | A | 6/2014 |
| JP | 2015-034637 | A | 2/2015 |
| JP | 2016061543 | A | 4/2016 |

OTHER PUBLICATIONS

Office Action for Corresponding Korean Application No. 10-2019-7007327, dated Jun. 4, 2020, 5 Pages, English Translation 4 Pages.
Office Action of Corresponding Chinese Patent Application No. 201780065586.1, dated Aug. 5, 2020, 8 pages, English Translation 11 pages.

* cited by examiner

U-U Cross-Section

V-V Cross-Section

ACCUMULATOR

CROSS-REFERENCE TO RELATED APPLICATIONS

This application is a 371 of PCT/JP2017/035313, filed Sep. 28, 2017, which claims benefit of Japanese Patent Application Nos. 2016-208702 filed on Oct. 25, 2016 and 2017-002268, filed on Jan. 11, 2017.

TECHNICAL FIELD

The present invention relates to accumulators (i.e., gas-liquid separators) for use in the heat pump refrigeration cycles of car air conditioners, room air conditioners, refrigerators, and the like (hereinafter referred to as heat pump systems).

BACKGROUND ART

As exemplarily illustrated in FIGS. 9A and 9B, a typical heat pump system 200 that forms a car air conditioner or the like includes an accumulator 250 in addition to a compressor 210, an outdoor heat exchanger 220, an indoor heat exchanger 230, an expansion valve 260, a four-way switching valve 240, and the like.

In such a system 200, the four-way switching valve 240 switches operation between a cooling operation and a heating operation (i.e., switches between flow channels). During the cooling operation, a refrigerant is circulated in a cycle illustrated in FIG. 9A, and at that time, the outdoor heat exchanger 220 functions as a condenser and the indoor heat exchanger 230 functions as an evaporator. Meanwhile, during the heating operation, a refrigerant is circulated in a cycle illustrated in FIG. 9B, and at that time, the outdoor heat exchanger 220 functions as an evaporator and the indoor heat exchanger 230 functions as a condenser. In both the operations, a low-temperature, low-pressure refrigerant in a gas-liquid mixed state is introduced into the accumulator 250 from the evaporator (i.e., the indoor heat exchanger 230 or the outdoor heat exchanger 220) via the four-way switching valve 240.

Examples of the known accumulator 250 include the one disclosed in Patent Literature 1 that includes a cylindrical tank having a bottom and an open upper face, which is hermetically closed by a cap member having an inlet port and an outlet port; a gas-liquid separator in the shape of a conical hat or an inverted wide bowl that has a smaller diameter than the inside diameter of the tank; an outlet pipe with a double-pipe structure of an inner pipe, which is coupled at its upper end to the outlet port and extending downward, and an outer pipe; a strainer provided around the bottom of the outlet pipe (or the outer pipe thereof), for trapping or removing foreign matter contained in a liquid-phase refrigerant and oil (i.e., oil for the refrigerator) mixed therewith; and the like.

A refrigerant introduced into the accumulator 250 collides with the gas-liquid separator and is radially diffused to be separated into a liquid-phase refrigerant and a gas-phase refrigerant. Then, the liquid-phase refrigerant (including oil) flows downward along the inner peripheral face of the tank and accumulates in the lower portion of the tank, while the gas-phase refrigerant flows downward through a space (i.e., a gas-phase-refrigerant downward-feed flow channel) formed between the inner pipe and the outer pipe of the outlet pipe, so that the gas-phase refrigerant rises through a space inside the inner pipe and is suctioned to the suction side of the compressor 210 so as to be circulated.

Meanwhile, oil that has accumulated in the lower portion of the tank together with the liquid-phase refrigerant moves toward the bottom of the tank due to the difference in specific gravity, properties, and the like between the oil and the liquid-phase refrigerant, and is absorbed into the gas-phase refrigerant to be suctioned to the suction side of the compressor via the outlet pipe. The oil passes through the strainer (or a mesh filter thereof)→an oil return hole formed at the bottom of the outlet pipe (i.e., the outer pipe)→a space inside the inner pipe of the outlet pipe, and thus is returned to the suction side of the compressor together with the gas-phase refrigerant so as to be circulated (see also Patent Literature 2 and 3).

By the way, when the operation of the system (i.e., the compressor) stops, the liquid-phase refrigerant including the oil accumulates in the lower portion of the tank of the accumulator. If oil that is incompatible with the refrigerant and has lower specific gravity than that of the refrigerant is used, the liquid-phase refrigerant including the oil is separated into two layers that are an oil layer formed on the upper side and a liquid-phase refrigerant layer formed on the lower side, due to the difference in specific gravity and viscosity between the liquid-phase refrigerant and the oil.

When the system (i.e., the compressor) is operated in such a two-layer separated state, pressure inside the tank drops rapidly. Therefore, a problem would arise that the liquid-phase refrigerant boils suddenly (such a phenomenon shall be hereinafter referred to as "bumping"), thus generating large impact noise.

As a cause of the generation of such a bumping phenomenon and impact noise associated therewith, it is estimated that even when pressure in the tank (i.e., on the suction side of the compressor) decreases while the compressor is operating, the oil layer serves as a lid for the refrigerant layer until a given time point (as the bumping phenomenon does not occur in the oil layer) and generation of the bumping phenomenon can thus be suppressed, but when the difference in pressure between the side above the oil layer (or the gas-phase refrigerant) and the side below the oil layer (or the liquid-phase refrigerant) becomes greater than or equal to a predetermined level, the liquid-phase refrigerant suddenly boils explosively (see also Patent Literature 2 that describes a bumping phenomenon in a compressor).

Meanwhile, when the oil and the liquid-phase refrigerant are not separated in two layers unlike the above after the operation of the compressor has stopped, that is, when the oil and the liquid-phase refrigerant remain in a mixed state after the operation of the compressor has stopped, or even when oil that is incompatible with the refrigerant and has higher specific gravity than that of the refrigerant is used as the oil, and a liquid-phase refrigerant layer is formed on the upper side and an oil layer is formed on the lower side, there may be cases where the aforementioned bumping phenomenon in which the liquid-phase refrigerant suddenly boils explosively and impact noise associated therewith may occur depending on the conditions, such as the types, properties, and the like, of the refrigerant and the oil.

As a method for suppressing generation of such a bumping phenomenon and impact noise associated therewith, Patent Literature 2 proposes providing agitation blades on the rotating shaft (i.e., crankshaft) of a compressor that uses a reciprocating engine as a drive source, and rotating the agitation blades while the compressor is operating so as to agitate the portion of the oil layer, thereby discharging the liquid-phase refrigerant to a portion above the oil.

In addition, Patent Literature 3 proposes, with a main objective of surely mixing oil and a liquid-phase refrigerant, which have been separated in two layers, in an accumulator (or a tank thereof), blowing a part of a gas-phase refrigerant, which has been discharged from a compressor, into the liquid-phase refrigerant from the bottom of the tank via a bypass flow channel with an on-off valve so that the liquid-phase refrigerant and the oil are agitated with the gas-phase refrigerant.

CITATION LIST

Patent Literature

Patent Literature 1: JP 2014-70869 A
Patent Literature 2: JP 2001-248923 A
Patent Literature 3: JP 2004-263995 A

SUMMARY OF INVENTION

Technical Problem

The inventors have also found that agitating a liquid portion including oil and a liquid-phase refrigerant in a tank while a compressor is operating can suppress generation of a bumping phenomenon and impact noise associated therewith to a certain extent as described above. However, in reality, it is impossible to fully eliminate impact noise associated with the bumping phenomenon using the conventional technique proposed so far. Further, the conventional technique proposed so far requires additional means for agitation (e.g., agitation blades and a drive source for rotating them, or a bypass flow channel with an on-off valve). Thus, there have been problems in that the accumulator (and a heat pump system including the accumulator) becomes complex, and the cost and size increase, for example.

The present invention has been made in view of the foregoing, and it is an object of the present invention to provide an accumulator that can effectively suppress impact noise associated with a bumping phenomenon when a compressor is operating, without an increase in the complexity, cost, or size of the accumulator.

Solution to Problem

Accordingly, an accumulator in accordance with the present invention basically includes a tank having an inlet port and an outlet port; a gas-liquid separation accelerating plate arranged in the tank so that a refrigerant that has flowed into the tank via the inlet port collides with the gas-liquid separation accelerating plate; and an outlet pipe coupled at one end to the outlet port and opening at the other end inside the tank, in which the inlet port is disposed in a lower portion of the tank, and the gas-liquid separation accelerating plate is disposed above the inlet port inside the tank so that the gas-liquid separation accelerating plate is opposite the inlet port.

The outlet port is preferably provided in the lower portion or an upper portion of the tank.

In a preferred embodiment, an opening of a lower face of the tank is hermetically closed by a bottom cap member in which the inlet port and the outlet port are provided.

In another preferred embodiment, the outlet pipe is integrally formed with the outlet port.

In a further preferred embodiment, the outlet port is provided in the center of the bottom cap member.

In a further preferred embodiment, the gas-liquid separation accelerating plate is integrally formed with a strainer, the strainer being disposed at the lower end of the outlet pipe.

In a further preferred embodiment, the accumulator further includes a bag holding portion, the bag holding portion being integrally formed with the gas-liquid separation accelerating plate and the strainer and being adapted to hold a bag containing desiccants.

In a further preferred embodiment, the accumulator further includes a reinforcing upright plate, the reinforcing upright plate being integrally formed with the gas-liquid separation accelerating plate and the strainer and having an outer periphery adapted to abut the inner periphery of the tank.

In another preferred embodiment, an opening of an upper face of the tank is hermetically closed by a cap member in which the outlet port is provided.

In a further preferred embodiment, the outlet pipe has a double-pipe structure of an inner pipe and an outer pipe, the inner pipe being coupled to the outlet port and extending downward inside the tank, and the outer pipe being arranged on the outer periphery of the inner pipe.

In another preferred embodiment, the outlet port is provided in the center of the cap member.

In another preferred embodiment, the gas-liquid separation accelerating plate is integrally formed with a strainer, the strainer being disposed at a lower end of the outlet pipe and being placed on the bottom of the tank.

In another preferred embodiment, the accumulator further includes a rib, the rib being integrally formed with the outlet pipe and having an outer periphery adapted to abut the inner periphery of the tank.

In a further preferred embodiment, the accumulator further includes a bag containing desiccants, the bag being arranged between the gas-liquid separation accelerating plate and the rib.

Advantageous Effects of Invention

In the accumulator in accordance with the present invention, a refrigerant in a gas-liquid mixed state is introduced upward into the tank via the inlet port provided in the lower portion of the tank so that the refrigerant is diffused radially while accumulating on the lower face side of the gas-liquid separation accelerating plate arranged above the inlet port, and the diffused refrigerant moves upward through a gap between the inner peripheral face of the tank and the outer peripheral face of the gas-liquid separation accelerating plate, for example. Thus, gas-liquid separation is accelerated and the liquid-phase refrigerant is agitated, in particular, above the gas-liquid separation accelerating plate. Therefore, a bumping phenomenon in which the liquid-phase refrigerant suddenly boils explosively when the compressor is operating and impact noise associated therewith can be effectively suppressed.

In such a case, it is basically acceptable as long as the inlet port is disposed in the lower portion of the tank, and the gas-liquid separation accelerating plate is disposed above the inlet port inside the tank. Therefore, in comparison with when agitation blades and a drive source for driving them, or a bypass flow channel with an on-off valve is used as agitation means as in the conventional art, for example, the configuration of the accumulator can be simplified, and the cost and size can be reduced.

DESCRIPTION OF EMBODIMENTS

Hereinafter, an embodiment of the present invention will be described with reference to the drawings.

First Embodiment

Figure 1:
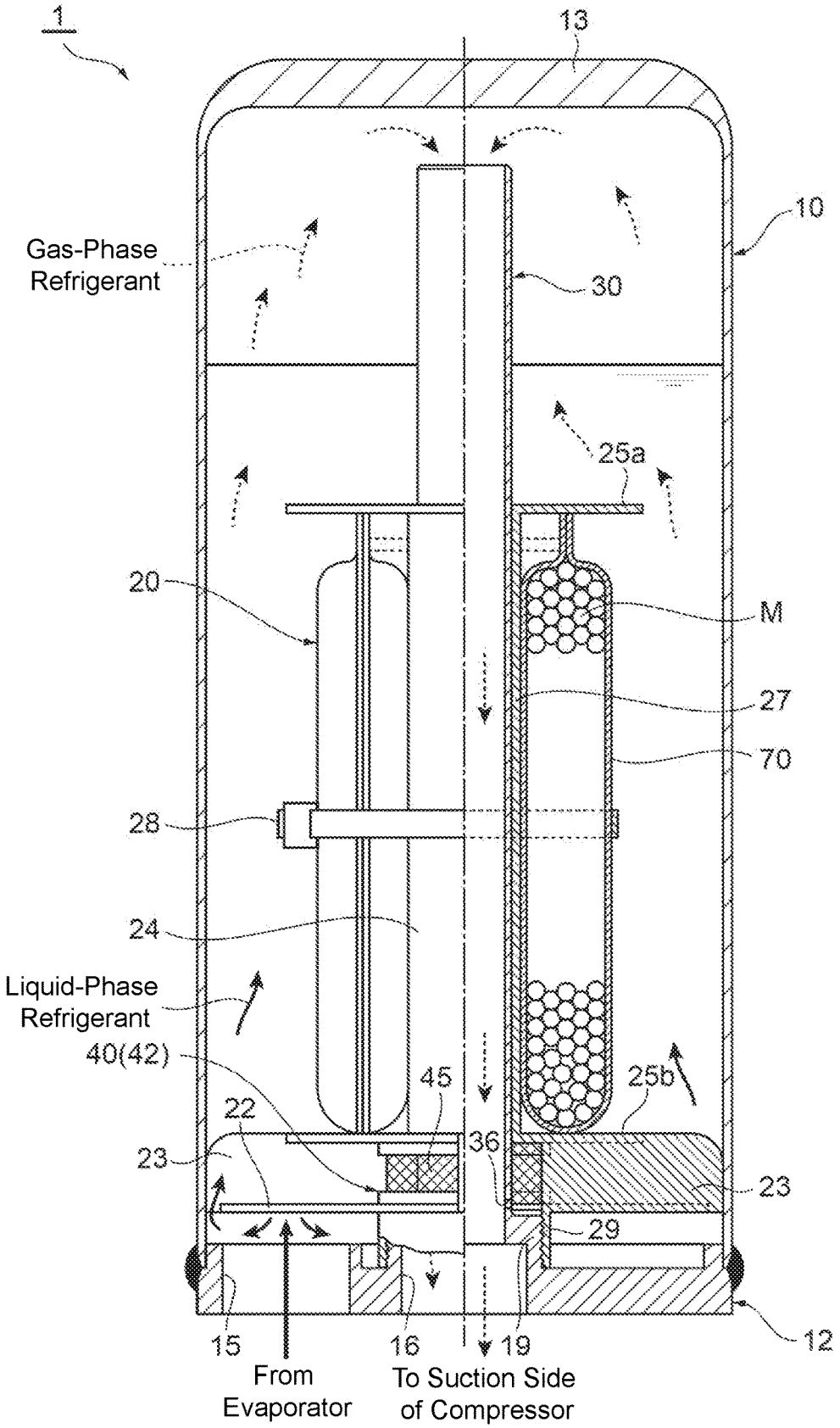
FIG. 1 is a partially cutaway half longitudinal sectional view illustrating a first embodiment of the accumulator in accordance with the present invention.

FIG. 1 is a partially cutaway half longitudinal sectional view illustrating a first embodiment of the accumulator in accordance with the present invention.

Figure 9A:
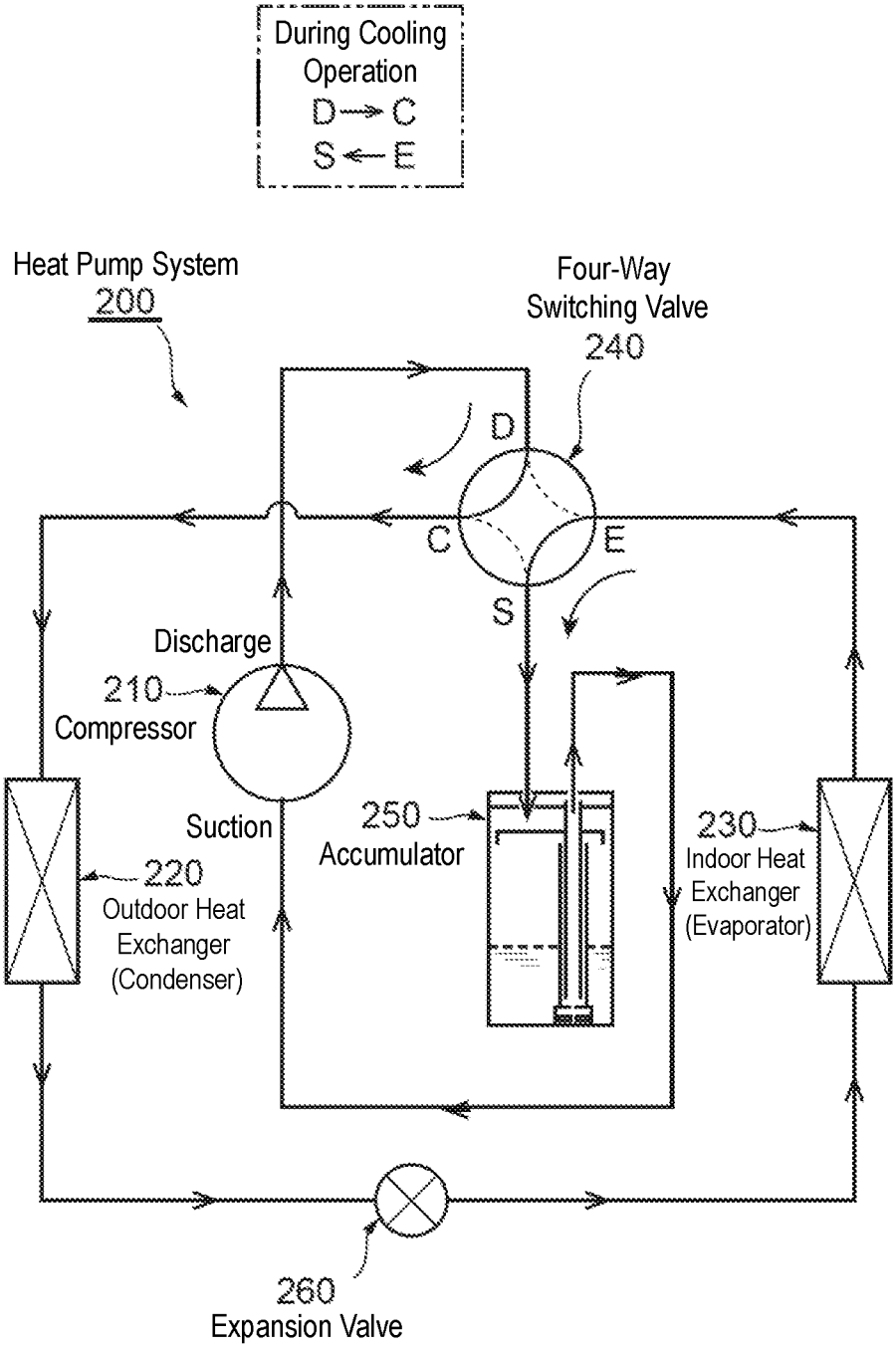
FIG. 9A is a schematic configuration view of an example of a heat pump system, specifically, a refrigerant flow (i.e., cycle) during the cooling operation.
Figure 9B:
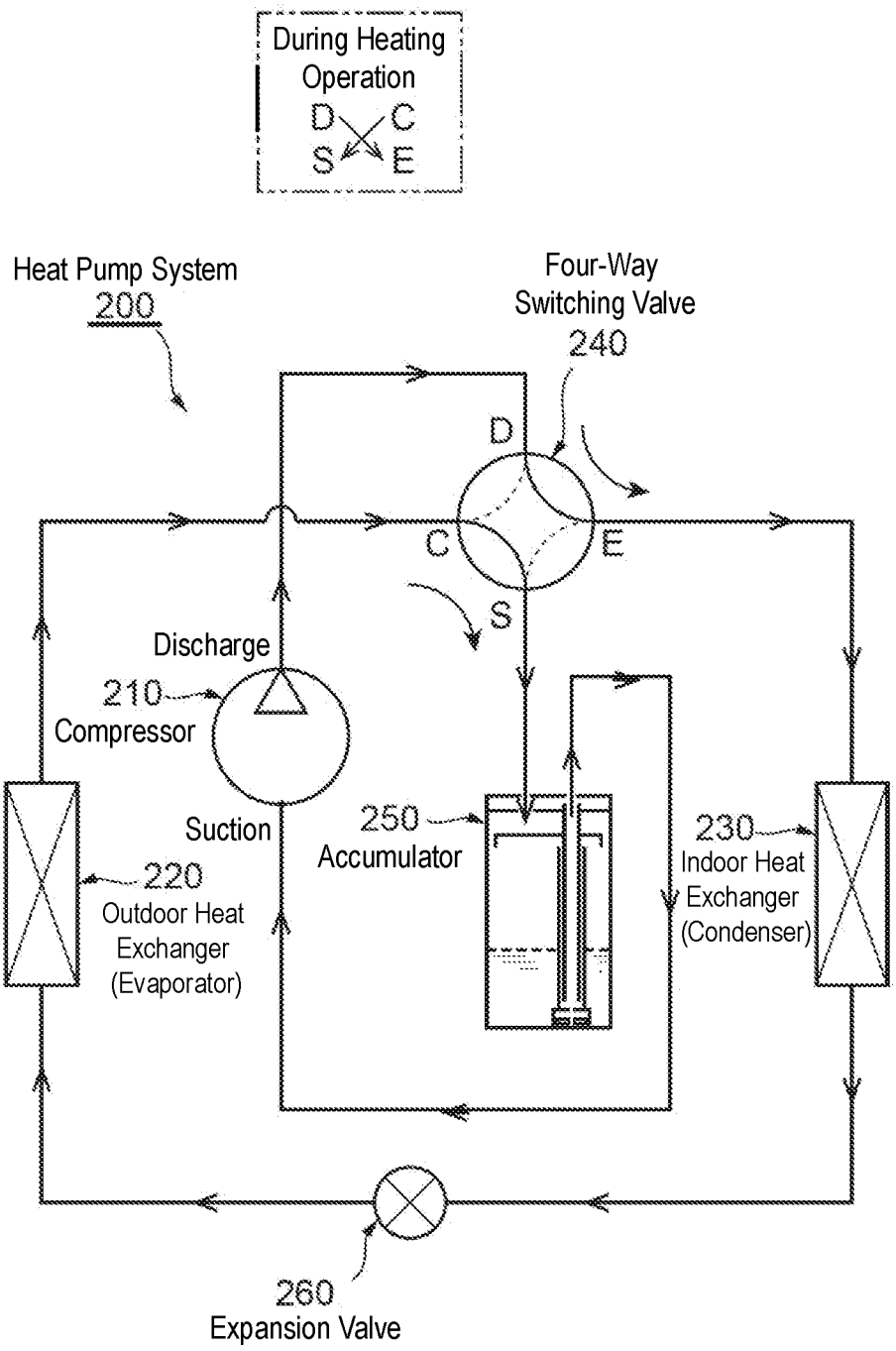
FIG. 9B is a schematic configuration view of an example of a heat pump system, specifically, a refrigerant flow (i.e., cycle) during the heating operation.

An accumulator 1 of the embodiment illustrated in the drawing is used for the accumulator 250 of the heat pump system 200 that forms a car air conditioner for electric vehicles, for example, as illustrated in FIGS. 9A and 9B described previously. The accumulator 1 includes a cylindrical tank 10 made of metal, such as stainless steel or aluminum alloy, and having a ceiling face and an open lower face. The opening of the lower face of the tank 10 is hermetically closed by a bottom cap member 12 made of the same metal. It should be noted that the accumulator 1 of this embodiment is placed in a vertical, upright position as illustrated, for example. That is, the bottom cap member 12 is located on the lower (bottom) side, and the ceiling face 13 of the tank 10 is located on the upper (top) side.

The bottom cap member 12 has an inlet port 15 and an outlet port 16 that are arranged side by side such that the inlet port 15 and the outlet port 16 penetrate through the bottom cap member 12 and open at the top and bottom sides thereof. Herein, the outlet port 16 is provided in the center of the bottom cap member 12 (i.e., on the center line of the tank 10), and the inlet port 15 is provided on the left side thereof.

The outlet port 16 is provided with an outlet pipe 30 made of a straight pipe (i.e., a linear pipe arranged along the center line) that is arranged continuously for guiding a gas-phase refrigerant from the upper portion of the tank 10 to the outlet port 16. An opening on the upper end side (i.e., another end side) of the outlet pipe 30 is located slightly below the ceiling face 13 of the tank 10. The outlet pipe 30 may be either integrally formed with the bottom cap member 12 or be formed separately from the bottom cap member 12 but then attached thereto through swaging or the like.

The upper face side of the bottom cap member 12 has, in its center portion (which includes the outlet port 16 in the center), an inner fit-in coupling portion 19 in a short cylindrical shape that protrudes upward and has an external thread portion to which an internal unit 20 (described below) is adapted to be screwed so that the internal unit 20 and the bottom cap member 12 are coupled together.

Figure 2A:
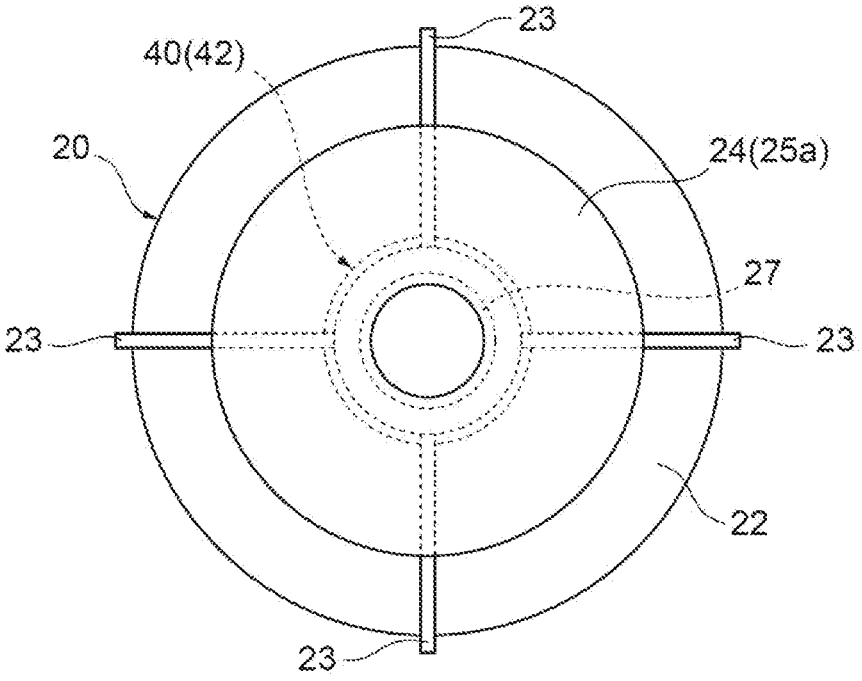
FIG. 2A is a plan view of an internal unit of the accumulator of the first embodiment.
Figure 2B:
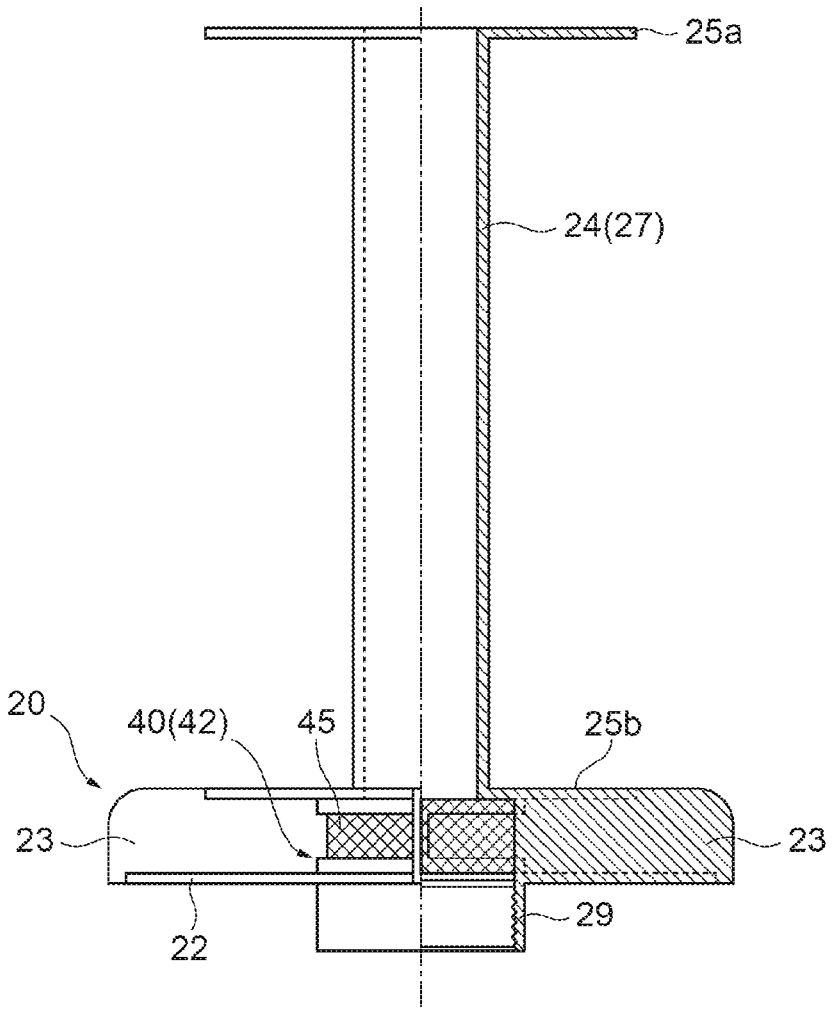
FIG. 2B is a half longitudinal sectional view of the internal unit of the accumulator of the first embodiment.

The internal unit 20 is disposed inside the tank 10. The internal unit 20 is made of synthetic resin, for example, and includes in its lower portion a gas-liquid separation accelerating plate 22 in an annular disk shape as seen in FIG. 1 in conjunction with FIGS. 2A and 2B. The gas-liquid separation accelerating plate 22 has an annular disk shape with its outside diameter slightly smaller than the inside diameter of the tank 10 and with its inside diameter approximately equal to the inside diameter of a strainer 40 (described below) and is located above the upper face of the bottom cap member 12 (or the inlet port 15 therein) by a predetermined distance so that the lower face of the gas-liquid separation accelerating plate 22 is opposite the inlet port 15. Thus, the gas-liquid separation accelerating plate 22 radially diffuses a refrigerant that has flowed into the tank 10 via the inlet port 15 and collided with the gas-liquid separation accelerating plate 22 and the refrigerant that has collided with the gas-liquid separation accelerating plate 22 and diffused can flow upward through a gap between the inner peripheral face of the tank 10 and the outer peripheral face of the gas-liquid separation accelerating plate 22.

The lower face side of the gas-liquid separation accelerating plate 22 has in its center an outer fit-in coupling portion 29 in a short cylindrical shape that protrudes downward and has an internal thread portion adapted to be screwed to the external thread portion of the inner fit-in coupling portion 19 provided on the bottom cap member 12. Accordingly, the bottom cap member 12 and the internal unit 20 can be coupled together through screwing, thus facilitating the assembly.

The upper face side of the gas-liquid separation accelerating plate 22 has in its center a strainer 40 that surrounds the lower end of the outlet pipe 30, and four reinforcing upright plates 23 disposed upright on the outer periphery of the upper face side of the strainer 40 at equiangular intervals (that is, at intervals of) 90°. The outer peripheries of the reinforcing upright plates 23 abut the inner periphery of the tank 10. In the example illustrated in the drawing, the reinforcing upright plates 23 are disposed on the front, rear, right, and left on the outer periphery of the upper face side of the gas-liquid separation accelerating plate 22, and one of the reinforcing upright plates 23 is arranged such that it is directly above the inlet port 15 provided in the bottom cap member 12.

A bobbin-shaped bag holding portion 24, which has a long cylindrical portion 27 with a slightly smaller diameter than those of the outlet port 16 and the strainer 40, and is adapted to have the outlet pipe 30 inserted therein, is integrally formed above the strainer 40 and on the inner peripheral side of the reinforcing upright plates 23. The bobbin-shaped bag holding portion 24 is obtained by winding a bag 70, which contains desiccants M, in a cylindrical shape or in a C-shape as seen in plan view around the long cylindrical portion 27, and further winding a cable tie 28 around the outer periphery of the bag 70 so as to securely hold it. In such a case, the upper and lower ends of the bag 70 held are slightly pressed against a pair of upper and lower flanges 25*a* and 25*b* of the bag holding portion 24, respectively. It should be noted that the bag 70 housed in the bag holding portion 24 is made of a fabric, such as felt with a ventilation property, a water permeation property, and a desired shape retention property, and is filled with granular desiccants M almost entirely. Herein, the bag 70 has a height about half or ⅔ that of the tank 10.

Meanwhile, the strainer 40 is integrally formed with the upper side of the gas-liquid separation accelerating plate 22, and includes a cylindrical mesh filter 45 and a case 42 to which the mesh filter 45 is securely attached. The mesh filter 45 is made of a metallic mesh or a mesh member of synthetic resin, for example. The case 42 includes upper and lower annular disk portions and inner peripheral edges (four portions) of the reinforcing upright plates 23 located therebetween. That is, four windows that are rectangular as seen in side view are defined between the four respective columnar portions (i.e., the inner peripheral edges), and the mesh filter 45 is stretched over the respective windows. It should be noted that the mesh filter 45 may be integrally formed with the case 42 (i.e., the internal unit 20) through insert molding when the case 42 is molded.

An oil return hole 36 is provided near the lower end of the outlet pipe 30, which is integrally molded with the bottom cap member 12 or provided in an integral manner with the bottom cap member 12 through swaging or the like, that is, on the inner side of the mesh filter 45 and below the mesh filter 45 and above the outlet port 16. The diameter of the oil return hole 36 is set to about 1 mm, for example.

In the accumulator 1 with such a configuration, a low-temperature, low-pressure refrigerant in a gas-liquid mixed state from an evaporator is introduced upward into the tank 10 via the inlet port 15, and the introduced refrigerant is diffused radially while accumulating on the lower face of the gas-liquid separation accelerating plate 22. Then, the diffused refrigerant is moved upward while gradually passing through a gap between the inner peripheral face of the tank 10 and the outer peripheral face of the gas-liquid separation accelerating plate 22. Accordingly, the refrigerant is rectified and effectively separated into a liquid-phase refrigerant and a gas-phase refrigerant. In such a case, the liquid-phase refrigerant (including oil) accumulates in the lower space of the tank 10, while the gas-phase refrigerant moves upward toward the upper space of the tank 10 and is suctioned into the suction side of the compressor 210 via the upper space of the tank 10→the outlet pipe 30→the outlet port 16 so as to be circulated.

Oil that has accumulated in the lower space of the tank 10 together with the liquid-phase refrigerant moves toward the bottom cap member 12 of the tank 10 due to the difference in specific gravity, properties, and the like between the oil and the liquid-phase refrigerant, and is absorbed into the gas-phase refrigerant to be suctioned to the suction side of the compressor via the outlet pipe 30. The oil passes through the mesh filter 45 of the strainer 40→the oil return hole 36 and thus is returned to the suction side of the compressor together with the gas-phase refrigerant so as to be circulated. When the oil passes through the mesh filter 45, foreign matter, such as sludge, is trapped and thus is removed from the circulating refrigerant (including oil).

As described above, in the accumulator 1 of this embodiment, a refrigerant in a gas-liquid mixed state is introduced upward into the tank 10 via the inlet port 15 provided in the lower portion of the tank 10, and is diffused radially while accumulating on the lower face side of the gas-liquid separation accelerating plate 22, and then, the diffused refrigerant is moved upward through a gap between the inner peripheral face of the tank 10 and the outer peripheral face of the gas-liquid separation accelerating plate 22 so that the gas-liquid separation is accelerated. In particular, since the liquid-phase refrigerant is agitated as the gas-phase refrigerant rises in the liquid above the gas-liquid separation accelerating plate 22, it is possible to suppress generation of a bumping phenomenon in which the liquid-phase refrigerant suddenly boils explosively when the compressor is operating and impact noise associated therewith.

In this case, it is basically acceptable as long as the inlet port 15 is disposed in the lower portion of the tank 10, and the gas-liquid separation accelerating plate 22 is disposed above the inlet port 15 inside the tank 10. Therefore, in comparison with when agitation blades and a drive source for driving them, or a bypass flow channel with an on-off valve is used as agitation means as in the conventional art, for example, the configuration of the accumulator can be simplified, and the cost and size can be reduced.

Second Embodiment

Figure 3:
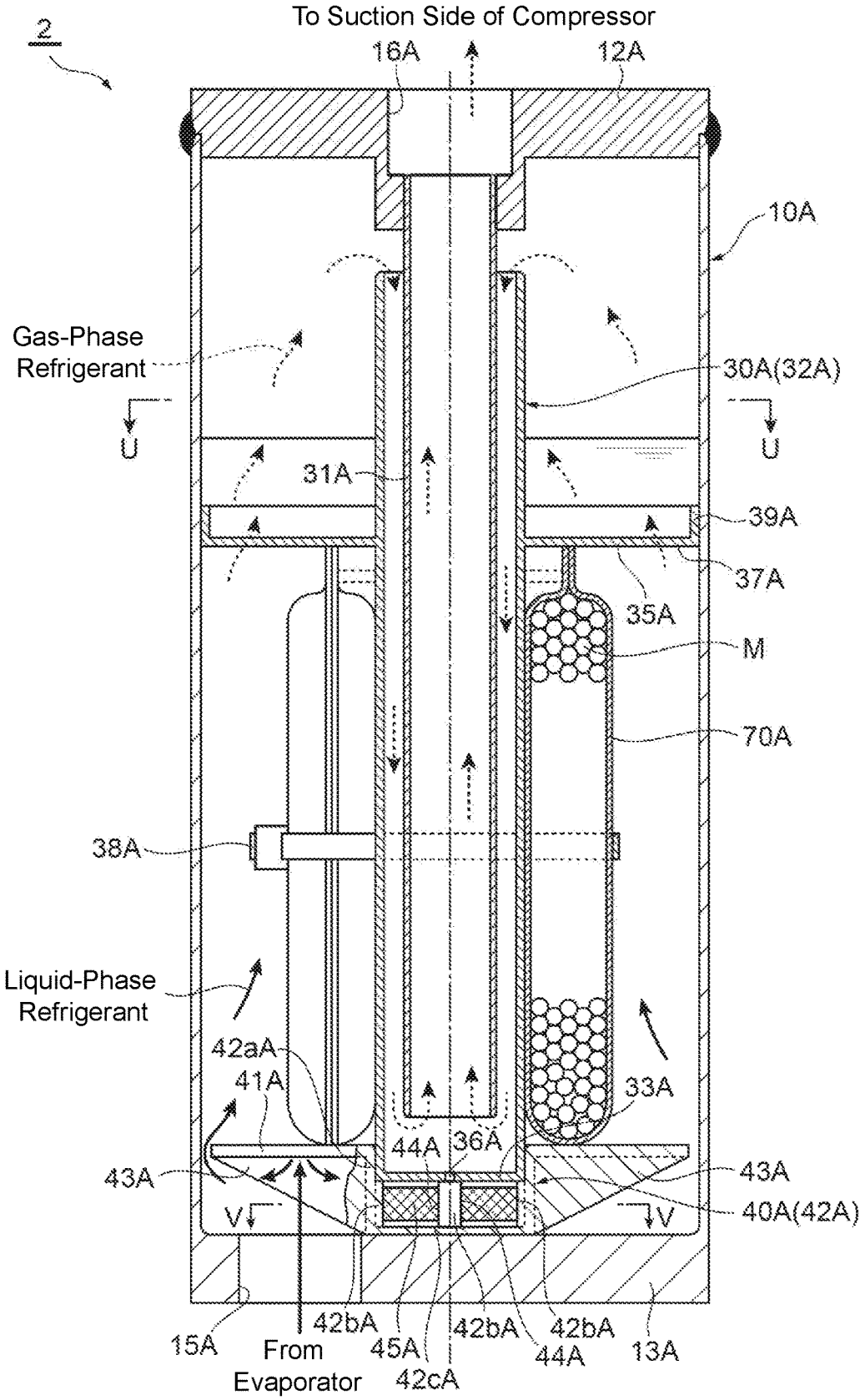
FIG. 3 is a partially cutaway longitudinal sectional view illustrating a second embodiment of the accumulator in accordance with the present invention.
Figure 4:
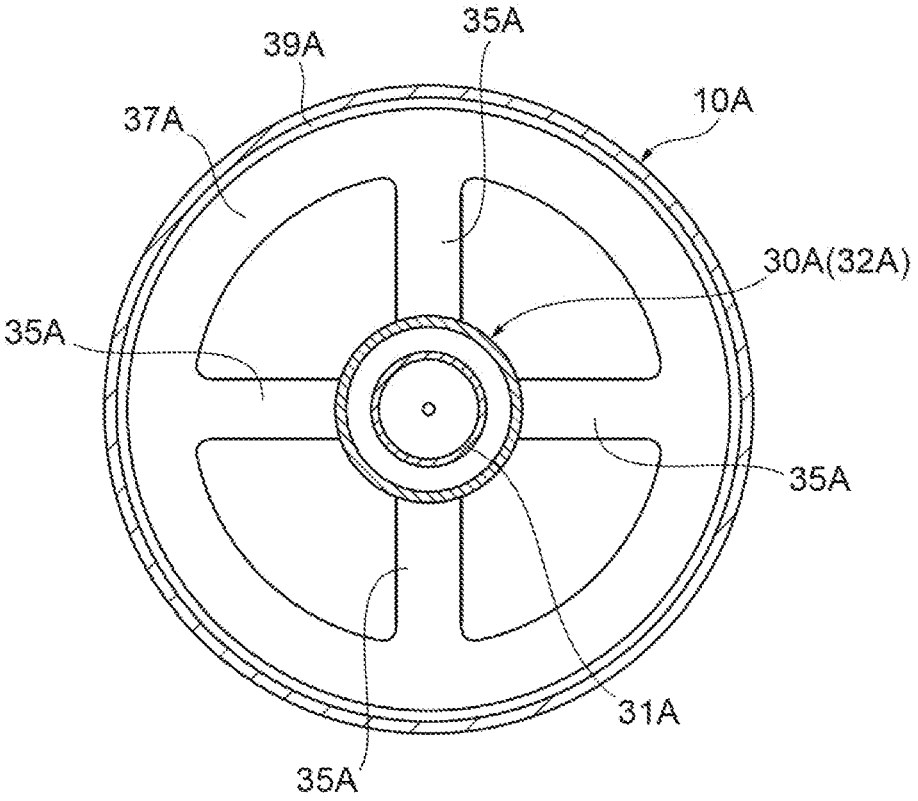
FIG. 4 is a cross-sectional view in the direction of the arrow U-U in FIG. 3.
Figure 5:
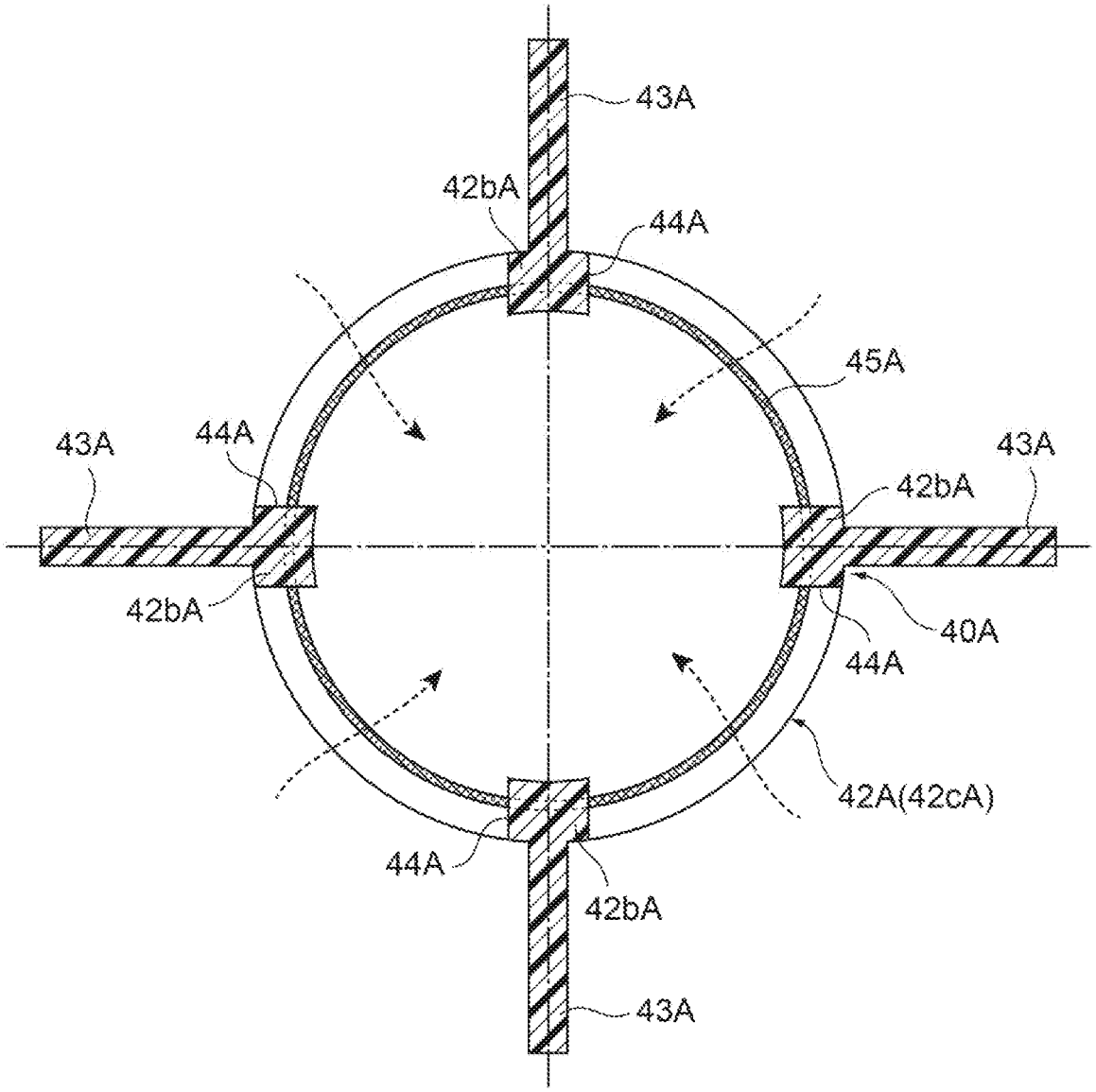
FIG. 5 is a cross-sectional view in the direction of the arrow V-V in FIG. 3.

FIG. 3 is a partially cutaway longitudinal sectional view illustrating a second embodiment of the accumulator in accordance with the present invention. FIG. 4 is a cross-sectional view in the direction of the arrow U-U in FIG. 3. FIG. 5 is a cross-sectional view in the direction of the arrow V-V in FIG. 3.

An accumulator 2 of the embodiment illustrated in the drawing is used as the accumulator 250 of the heat pump system 200 that forms an car air conditioner for electric vehicles, for example, as illustrated in FIGS. 9A and 9B described previously as in the first embodiment. The accumulator 2 includes a cylindrical tank 10A made of metal, such as stainless steel or aluminum alloy, and having a bottom. An opening of the upper face of the tank 10A is hermetically closed by a cap member 12A made of the same metal. It should be noted that the accumulator 2 of this embodiment is placed in a vertical, upright position as illustrated, for example. That is, the cap member 12A is located on the upper (top) side, and a bottom 13A of the tank 10A is located on the lower (bottom) side.

In FIG. 3, an inlet port 15A is provided on the left side of the center of the bottom 13A of the tank 10A (i.e., on the outer side of a strainer 40A placed on the bottom 13A) such that it penetrates through the bottom 13A and opens at the top and bottom sides thereof. Meanwhile, a stepped outlet port 16A is provided in the center of the cap member 12A (i.e., on the center line of the tank 10A) such that it penetrates through the cap member 12A and opens at the top and bottom sides thereof.

The upper end of an outlet pipe 30A, which is adapted to guide a gas-phase refrigerant to the outlet port 16A from the upper portion of the tank 10A, is coupled to the lower portion of the outlet port 16A.

The outlet pipe 30A has a double-pipe structure of an inner pipe 31A, which is made of metal, for example, and is coupled at its upper end to the lower portion of the outlet port 16A through swaging, press fit, or the like, and further extends downward inside the tank 10A, and an outer pipe 32A made of synthetic resin, for example, and having a bottom and arranged on the outer periphery of the inner pipe 31A.

Herein, ribs for securing a predetermined gap may be formed on at least one of the inner pipe 31A or the outer pipe 32A. For example, a plurality of plate-like ribs may be radially disposed on the outer side of the inner pipe 31A (i.e., portions thereof below the cap member 12A) in an outwardly protruding manner and at equiangular intervals along the longitudinal direction (i.e., the vertical direction), and the outer pipe 32A may be fixed to the outer peripheral side of the plate-like ribs in a press-fit manner. Alternatively, a plurality of plate-like ribs may be radially disposed on the inner side of the outer pipe 32A in an inwardly protruding manner and at equiangular intervals along the longitudinal direction (i.e., the vertical direction), and the inner pipe 31A may be securely inserted into the inner peripheral side of the plate-like ribs in a press-fit manner.

The lower end of the outer pipe 32A is securely fitted into an upper portion 42*a*A with a stepped inner periphery of a case 42A of the strainer 40A (which is described below) through press fitting or the like. The lower end of the inner pipe 31A is located slightly above the bottom 33A of the outer pipe 32A. The upper end of the outer pipe 32A (that is, an opening on the upper end side (i.e., another end side) of the outlet pipe 30A that is formed by the inner pipe 31A and the outer pipe 32A) is located slightly below the cap member 12A (or the outlet port 16A therein). An oil return hole 36A is formed in the center of the bottom 33A of the outer pipe 32A. The diameter of the oil return hole 36A is set to about 1 mm, for example.

In this embodiment, as clearly seen in FIG. 4, four ribs 35A, which extend in an approximate cross shape as seen in plan view, are integrally formed with the outer periphery of the outer pipe 32A at a position slightly above the intermediate portion of the outer pipe 32A (in the vertical direction) so as to securely hold the outlet pipe 30A (or the outer pipe 32A thereof) in the tank 10A, and a short cylindrical pressure plate 39A is disposed upright on the outer periphery of an annular ring portion 37A that couples the outer peripheries of the ribs 35A together. The pressure plate 39A (or the outer periphery thereof) is made to abut the inner periphery of the tank 10A. Passages for refrigerants are formed between the adjacent ribs 35A (i.e., four gaps in sector shapes as seen in plan view). Although the short cylindrical pressure plate 39A is placed such that it extends upwardly upright on the outer periphery of the annular ring portion 37A in FIG. 3, it may also be placed such that it extends downwardly upright.

Figure 6A:
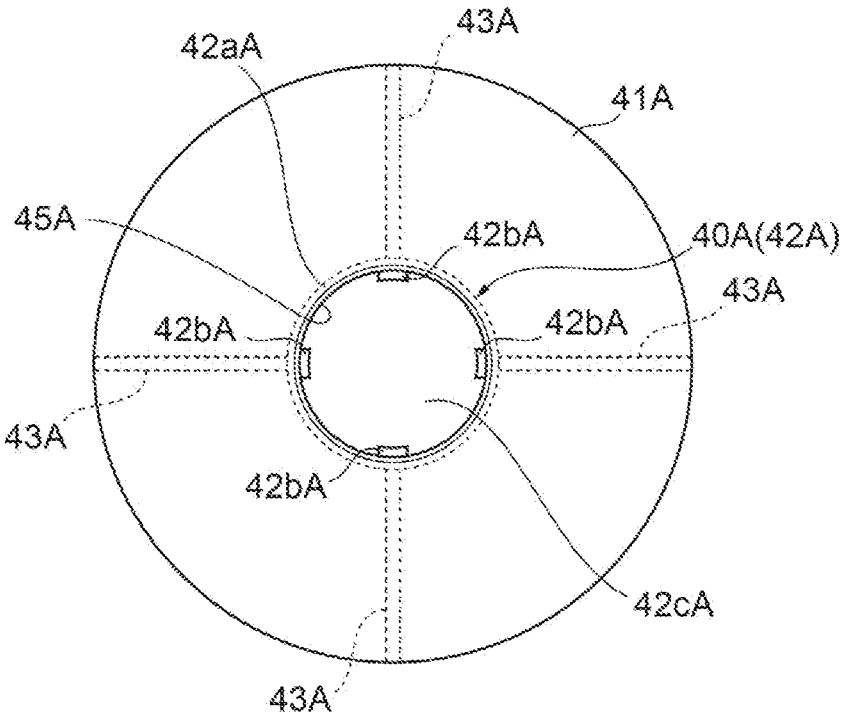
FIG. 6A is a plan view of a strainer having a gas-liquid separation accelerating plate of the accumulator of the second embodiment.
Figure 6B:
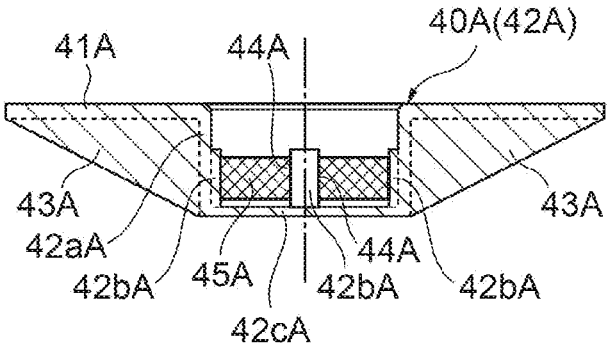
FIG. 6B is a longitudinal sectional view of the strainer having the gas-liquid separation accelerating plate of the accumulator of the second embodiment.

Meanwhile, the strainer 40A disposed at the lower end of the outlet pipe 30A is fixedly placed on the bottom 13A of the tank 10A. As clearly seen in FIGS. 5, 6A, and 6B, the strainer 40A includes a cylindrical case 42A made of synthetic resin and having a bottom, and a cylindrical mesh filter 45A integrally formed with the case 42A through insert molding or the like. The mesh filter 45A is made of a metallic mesh or a mesh member of synthetic resin, for example.

The case 42A of the strainer 40A includes an upper portion 42*a*A with a stepped inner periphery in which the lower end of the outer pipe 32A is adapted to be securely fitted, a bottom plate 42*c*A, and four columnar portions 42*b*A disposed upright on the outer periphery of the bottom plate 42*c*A at equiangular intervals such that they are coupled to the upper portion 42*a*A. An annular coupling band is provided on the outer periphery of the bottom plate 42*c*A, and the upper and lower ends of the mesh filter 45A are securely attached to the coupling band and the lower side of the upper portion 42*a*A. That is, four windows 44A that are rectangular as seen in side view are defined between the four respective columnar portions 42*b*A, and the mesh filter 45A is stretched over the respective windows 44A. It should be noted that the mesh filter 45 may be integrally formed with the case 42A through insert molding when the case 42A is molded. The four columnar portions 42*b*A are provided with slopes for demolding, and the widths of the four columnar portions 42*b*A in the radial direction are set approximately equal. Further, the method for providing the mesh filter 45A on the case 42A is not limited to that described above.

A gas-liquid separation accelerating plate 41A in an annular disk shape is integrally formed with the upper end of the case 42A of the strainer 40A. The gas-liquid separation accelerating plate 41A has an annular disk shape with its outside diameter slightly smaller than the inside diameter of the tank 10A and is located above the upper face of the bottom 13A (or the inlet port 15A therein) by a predetermined distance so that the lower face of the gas-liquid separation accelerating plate 41A is opposite the inlet port 15A. Thus, a refrigerant that has flowed into the tank 10A via the inlet port 15A collides with the gas-liquid separation accelerating plate 41A and is radially diffused, and the refrigerant that has collided and diffused flows upward through a gap between the inner peripheral face of the tank 10A and the outer peripheral face of the gas-liquid separation accelerating plate 41A.

Four reinforcing plates 43A, which are approximately in right triangle shapes as seen in side view, are integrally formed between the cylindrical case 42A (or the outer periphery thereof) and the gas-liquid separation accelerating plate 41A (or the lower face thereof) at equiangular intervals (that is, at intervals of 90°). In the example illustrated in the drawing, the reinforcing plates 43A are disposed on the front, rear, right, and left on the outer periphery of the case 42A. The strainer 40A is arranged such that one of the reinforcing plates 43A is located directly above the inlet port 15A provided in the bottom 13A. Needless to say, the strainer 40A may also be arranged such that an intermediate portion between a pair of adjacent reinforcing plates 43A is located directly above the inlet port 15A.

In addition, a bag 70A containing desiccants M is wound in a cylindrical shape or in a C-shape as seen in plan view around the outer periphery of the outer pipe 32A between the ribs 35A and the gas-liquid separation accelerating plate 41A. Further, a cable tie 38A is wound around the outer periphery of the bag 70A so as to securely hold it. In such a case, the upper and lower ends of the bag 70 held are slightly pressed against the ribs 35A and the gas-liquid separation accelerating plate 41A. That is, in this embodiment, the ribs 35A and the gas-liquid separation accelerating plate 41A are used as flanges for holding the upper side and the lower side of the bag 70A, respectively. Although the bag 70A wound around the outer periphery of the outlet pipe 30A (or the outer pipe 32A thereof) is depicted as having a height about half that of the tank 10A, it would be more advantageous if the bag 70A has a height corresponding to the maximum refrigerant storage amount of the tank 10A or greater than that and is formed as thin as possible, so as to secure a high refrigerant storage capacity and take a measure against bumping noise.

In the accumulator 2 with such a configuration, as in the accumulator 1 of the first embodiment, a low-temperature, low-pressure refrigerant in a gas-liquid mixed state from an evaporator is introduced upward into the tank 10A via the inlet port 15A, and the introduced refrigerant is diffused radially while accumulating on the lower face of the gas-liquid separation accelerating plate 41A. Then, the diffused refrigerant moves upward through a gap between the inner peripheral face of the tank 10A and the outer peripheral face of the gas-liquid separation accelerating plate 41A. Accordingly, the refrigerant is rectified and effectively separated into a liquid-phase refrigerant and a gas-phase refrigerant. In such a case, the liquid-phase refrigerant (including oil) accumulates in the lower space of the tank 10A, and the gas-phase refrigerant rises toward the upper space of the tank 10A so as to be suctioned to the suction side of the compressor 210 via the upper space of the tank 10A→a space (i.e., a gas-phase refrigerant downward-feed flow channel) formed between the inner pipe 31A and the outer pipe 32A of the outlet pipe 30A→the inner space of the inner pipe 31A→the outlet port 16A so as to be circulated.

Oil that has accumulated in the lower space of the tank 10A together with the liquid-phase refrigerant moves toward the bottom 13A of the tank 10A due to the difference in specific gravity, properties, and the like between the oil and the liquid-phase refrigerant, and is absorbed into the gas-phase refrigerant to be suctioned to the suction side of the compressor via the outlet pipe 30A. The oil passes through the mesh filter 45A of the strainer 40A→the oil return hole 36A→the inner space of the inner pipe 31A and thus is returned to the suction side of the compressor together with the gas-phase refrigerant so as to be circulated. When the oil passes through the mesh filter 45A, foreign matter, such as sludge, is trapped and thus is removed from the circulating refrigerant (including oil).

Therefore, advantageous effects approximately the same as those of the aforementioned first embodiment can be obtained.

Although the aforementioned second embodiment adopts the outlet pipe 30A with a double-pipe structure of the inner pipe 31A and the outer pipe 32A, it is needless to say that the present invention can also be applied to an accumulator with a U-shaped outlet pipe that is coupled at one end to the outlet port and is opening at the other end (i.e., an opening) to the upper space of the tank, for example.

Third Embodiment

Figure 7:
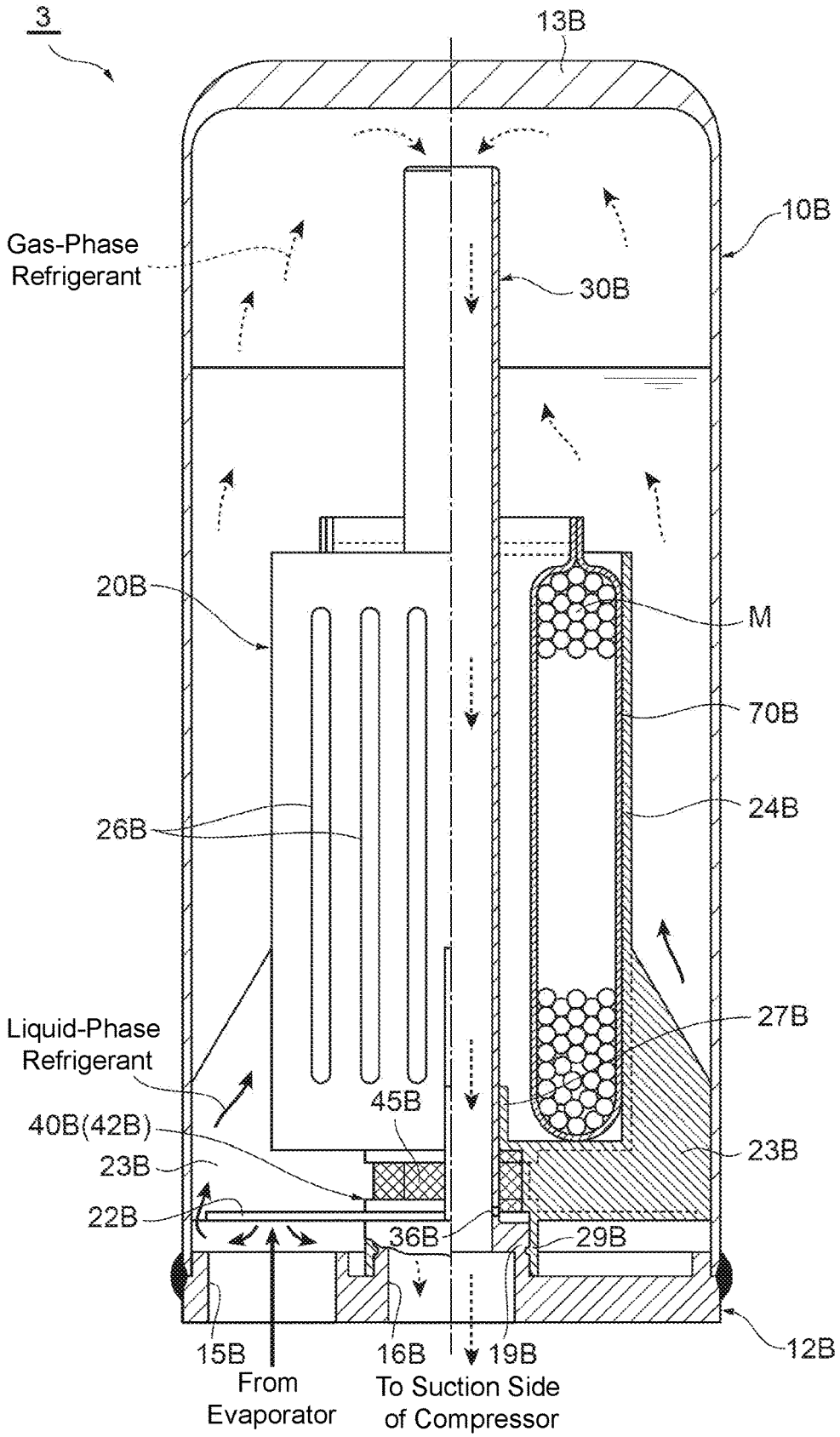
FIG. 7 is a partially cutaway half longitudinal sectional view illustrating a third embodiment of the accumulator in accordance with the present invention.

FIG. 7 is a partially cutaway half longitudinal sectional view illustrating a third embodiment of an accumulator in accordance with the present invention.

An accumulator 3 of the embodiment illustrated in the drawing differs from the accumulator 1 of the aforementioned first embodiment in the structure of the bag holding portion of the internal unit 20 and the structure of the coupled portion of the bottom cap member 12 and the internal unit 20, but the other portions are basically the same. Therefore, portions with the same functions shall be denoted by similar reference numerals ("B" is added to the reference numeral of each portion of the first embodiment) and repeated description thereof shall be omitted. Thus, the following describes only the differences.

In the accumulator 3 of this embodiment, the center portion of the upper face side of a bottom cap member 12B has an inner fit-in coupling portion 19B in a short cylindrical shape having an annular recess into which an internal unit 20B is adapted to be coupled in a snap-fit manner, while the internal unit 20B (or the center of the lower face side of a gas-liquid separation accelerating plate 22B) has an outer fit-in coupling portion 29B in a short cylindrical shape having an annular protrusion that is adapted to be housed in the annular recess of the inner fit-in coupling portion 19B. Such a snap-fit arrangement also facilitates the assembly.

Figure 8A:
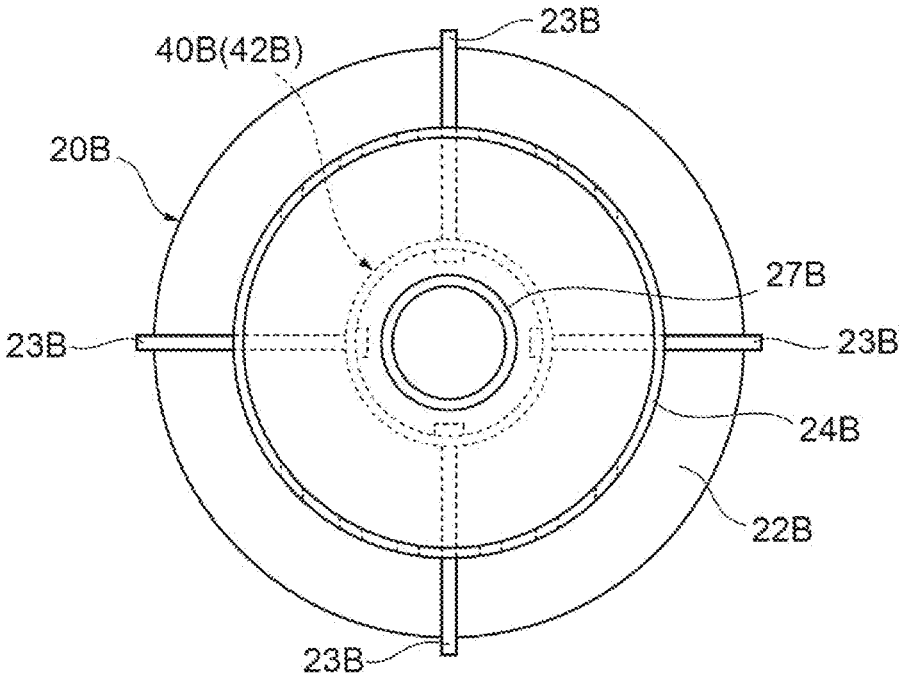
FIG. 8A is a plan view of an internal unit of the accumulator of the third embodiment.
Figure 8B:
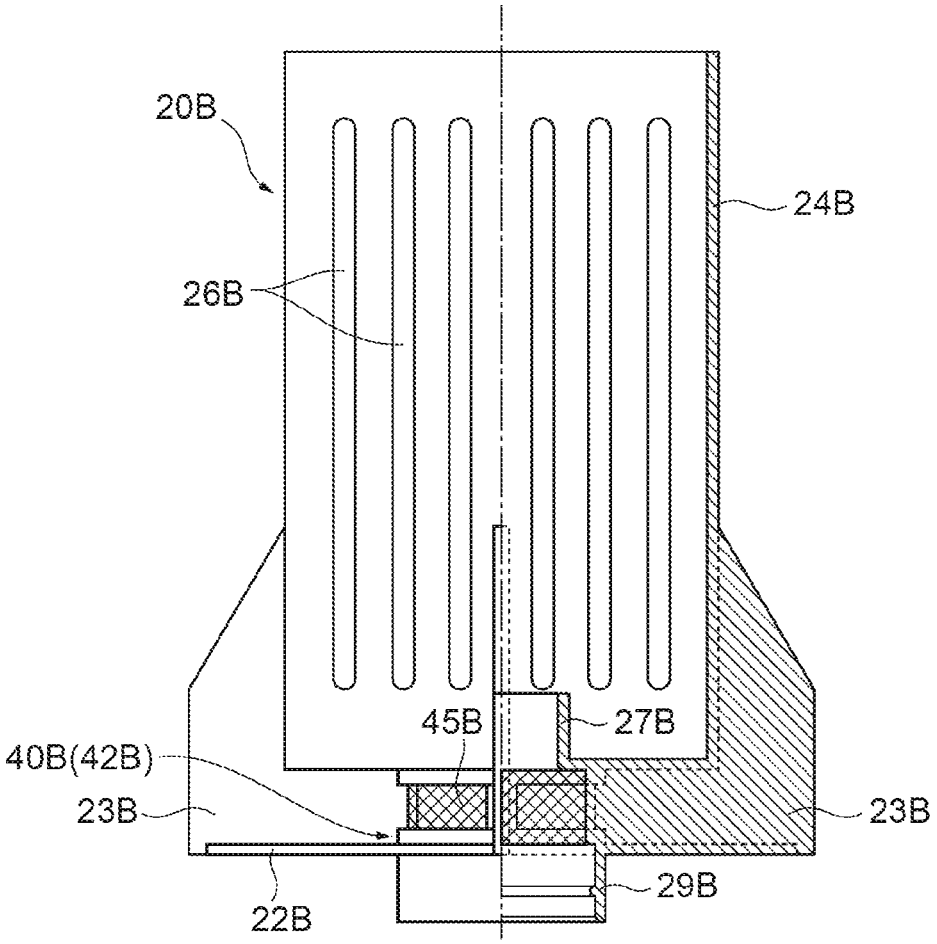
FIG. 8B is a half longitudinal sectional view of the internal unit of the accumulator of the third embodiment.

Further, in this embodiment, as clearly seen in FIGS. 8A and 8B in addition to FIG. 7, a cylindrical bag holding portion 24B having a bottom and holding a bag 70B containing desiccants M, which is pressed therein substantially entirely and is would in a cylindrical or a C-shape as seen in plan view, is integrally formed with the inner peripheral side of reinforcing upright plates 23B above a strainer 40B of the internal unit 20B. The bag holding portion 24B has formed a plurality of elongated holes 26B for passing a refrigerant in its thickness direction. In addition, a central tubular portion 27B having a short cylindrical shape and a small diameter, which is adapted to have the outlet pipe 30B inserted (press-fitted) therein, is provided on the inner peripheral side of the bag holding portion 24B, so that the outlet pipe 30B is inserted, with some clearance, into the inner side of the bag 70B housed in the bag holding portion 24B. It is also possible to form the bag 70B containing desiccants M roundish so as to follow the inner periphery of the bag holding portion 24B in advance, and house the bag 70B in the bag holding portion 24B, and thereafter insert (press-fit) the outlet pipe 30B into the central tubular portion 27B so that the bag holding portion 24B is mounted on the bottom cap member 12B and thus is arranged in the tank 10B. Alternatively, it is also possible to mount the bag holding portion 24B on the bottom cap member 12B so as to press-fit the outlet pipe 30B into the central tubular portion 27B, and thereafter insert the bag 70B containing desiccants M into the bag holding portion 24B so as to follow the inner periphery thereof, and thus arrange the bag 70B in the tank 10B.

That is, in this embodiment also, the internal unit 20B is integrally formed with the outer fit-in coupling portion 29B, the gas-liquid separation accelerating plate 22B, the strainer 40B, the reinforcing upright plates 23B, the bag holding portion 24B, and the like (in this order from the bottom side).

The other configurations are basically the same as those of the aforementioned first embodiment. Thus, needless to say, advantageous effects approximately the same as those of the first embodiment can be obtained.

In addition, in the present third embodiment, a cable tie and the like are not required for holding the bag containing desiccants in the bag holding portion. Therefore, there is an advantage in that the number of components can be reduced as compared to those of the aforementioned first embodiment.

REFERENCE SIGNS LIST

1 Accumulator (First Embodiment)
2 Accumulator (Second Embodiment)
3 Accumulator (Third Embodiment)
10 Tank
12 Bottom cap member
12A Cap member
13 Ceiling face of tank
13A Bottom of tank
15 Inlet port
16 Outlet port
19 Inner fit-in coupling portion
20 Internal unit
22 Gas-liquid separation accelerating plate
23 Reinforcing upright plate

24 Bag holding portion
27 Long cylindrical portion
28 Cable tie
29 Outer fit-in coupling portion
30 Outlet pipe
31A Inner pipe
32A Outer pipe
35A Rib
36 Oil return hole
38A Cable tie
40 Strainer
41A Gas-liquid separation accelerating plate
42 Case
45 Mesh filter
70 Bag
M Desiccant

The invention claimed is:

1. An accumulator comprising:

a tank having an inlet port and an outlet port;

a gas-liquid separation accelerating plate arranged in the tank so that a refrigerant that has flowed into the tank via the inlet port collides with the gas-liquid separation accelerating plate; and an outlet pipe coupled at one end to the outlet port and opening at another end inside the tank, wherein:

the inlet port is disposed in a lower portion of the tank, the gas-liquid separation accelerating plate is disposed above the inlet port inside the tank so that the gas-liquid separation accelerating plate is opposite the inlet port, and the gas-liquid separation accelerating plate is integrally formed with a strainer, the strainer being disposed at a lower end of the outlet pipe.

2. The accumulator according to claim 1, further comprising a bag holding portion, the bag holding portion being integrally formed with the gas-liquid separation accelerating plate and the strainer and being adapted to hold a bag containing desiccants.

3. The accumulator according to claim 1, wherein the outlet port is provided in the lower portion or an upper portion of the tank.

4. The accumulator according to claim 3, wherein an opening of a lower face of the tank is hermetically closed by a bottom cap member in which the inlet port and the outlet port are provided.

5. The accumulator according to claim 4, wherein the outlet pipe is integrally formed with the outlet port.

6. The accumulator according to claim 4, wherein the outlet port is provided in a center of the bottom cap member.

7. The accumulator according to claim 4, the accumulator further comprising a reinforcing upright plate, the reinforcing upright plate being integrally formed with the gas-liquid separation accelerating plate and the strainer and having an outer periphery adapted to abut an inner periphery of the tank.

8. The accumulator according to claim 3, wherein an opening of an upper face of the tank is hermetically closed by a cap member in which the outlet port is provided.

9. The accumulator according to claim 8, wherein the outlet pipe has a double-pipe structure of an inner pipe and an outer pipe, the inner pipe being coupled to the outlet port and extending downward inside the tank, and the outer pipe being arranged on an outer periphery of the inner pipe.

10. The accumulator according to claim 8, wherein the outlet port is provided in a center of the cap member.

11. The accumulator according to claim 8, wherein the strainer is placed on a bottom of the tank.

12. The accumulator according to claim 8, further comprising a rib, the rib being integrally formed with the outlet pipe and having an outer periphery adapted to abut an inner periphery of the tank.

13. The accumulator according to claim 12, further comprising a bag containing desiccants, the bag being arranged between the gas-liquid separation accelerating plate and the rib.

* * * * *